US010180051B2

(12) United States Patent
Vasques

(10) Patent No.: US 10,180,051 B2
(45) Date of Patent: Jan. 15, 2019

(54) DOWNHOLE PUMPING ASSEMBLY AND A DOWNHOLE SYSTEM

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 14/899,295

(22) PCT Filed: Jun. 25, 2014

(86) PCT No.: PCT/EP2014/063364
§ 371 (c)(1),
(2) Date: Dec. 17, 2015

(87) PCT Pub. No.: WO2014/207027
PCT Pub. Date: Dec. 31, 2014

(65) Prior Publication Data

US 2016/0130919 A1 May 12, 2016

(30) Foreign Application Priority Data

Jun. 26, 2013 (EP) ..... 13173705

(51) Int. Cl.
*E21B 43/12* (2006.01)
*E21B 33/126* (2006.01)
(Continued)

(52) U.S. Cl.
CPC ..... *E21B 43/121* (2013.01); *E21B 33/126* (2013.01); *E21B 43/103* (2013.01);
(Continued)

(58) Field of Classification Search
CPC ..... F04B 47/00; E21B 43/12; E21B 33/126
See application file for complete search history.

(56) References Cited

U.S. PATENT DOCUMENTS 3,114,327 A * 12/1963 Reynolds ..... F04B 47/00 417/434
3,202,104 A * 8/1965 Reynolds ..... F04B 47/00 417/434

(Continued)

FOREIGN PATENT DOCUMENTS

CN 1067713 A 1/1993
CN 201090212 Y 7/2008

(Continued)

OTHER PUBLICATIONS

International Preliminary Report on Patentability issued in International Application No. PCT/EP2014/063364 dated Jan. 7, 2016, 8 pages.

(Continued)

*Primary Examiner* — Matthew R Buck
*Assistant Examiner* — Aaron L Lembo
(74) *Attorney, Agent, or Firm* — Nixon & Vanderhye P.C.

(57) ABSTRACT

The present invention relates to a downhole pumping assembly for being introduced in a well inside a casing and submerged in well fluid, the downhole pumping assembly extending in a longitudinal direction and being adapted for connection with a wireline. The downhole pumping assembly comprises a pump section comprising a tubular pump housing providing a pump chamber, an inlet provided in the tubular pump housing, the inlet being in fluid communication with the pump chamber, a first valve which is a one-way valve arranged for opening and closing the inlet to allow fluid to flow into the chamber, a plunger slidably disposed in the pump chamber, a pump rod operably connected to the plunger and extending from the plunger through the tubular pump housing, an outlet provided in the tubular pump housing, the outlet being in fluid communication with the pump chamber, a second valve which is a one-way valve arranged for controlling a flow of fluid out of the chamber (Continued)

through the outlet. The downhole pumping assembly further comprises a linear actuator arranged in association with the tubular pump housing adapted to drive the pump rod, whereby, when the downhole pumping assembly is at least partially submerged into the well fluid, well fluid is drawn into the tubular pump housing through the inlet and expelled through the outlet in the tubular pump housing, and the pump section further comprises at least one sealing element for isolating a first part of the casing from a second part of the casing.

18 Claims, 13 Drawing Sheets

(51) Int. Cl.
*F04B 47/02* (2006.01)
*E21B 43/10* (2006.01)

(52) U.S. Cl.
CPC ..... *E21B 43/127* (2013.01); *E21B 43/128* (2013.01); *F04B 47/02* (2013.01); *F04B 47/026* (2013.01)

(56) References Cited

U.S. PATENT DOCUMENTS 3,468,258 A 9/1969 Arutunoff
3,838,945 A * 10/1974 Moore ..... E21B 43/12 417/378
4,037,661 A * 7/1977 Ford ..... E21B 37/08 166/223
4,768,595 A 9/1988 Smith
5,049,046 A 9/1991 Escue et al.
6,758,090 B2 * 7/2004 Bostrom ..... E21B 34/08 73/152.18
6,875,364 B2 * 4/2005 Gordon ..... B01D 29/15 210/107
7,234,518 B2 * 6/2007 Smith ..... E21B 34/10 166/227
7,273,106 B2 * 9/2007 Huckabee ..... E21B 43/08 166/227
7,367,393 B2 5/2008 Vachon
7,468,082 B2 * 12/2008 Gordon ..... B01D 46/0071 210/321.69
7,934,556 B2 * 5/2011 Clark ..... E21B 43/14 166/250.01
8,220,543 B2 * 7/2012 Clark ..... E21B 43/14 166/250.01
8,714,263 B2 * 5/2014 Sundararajan ..... E21B 33/064 166/338
8,727,012 B2 * 5/2014 Bhat ..... E21B 17/1007 166/338
9,243,490 B2 * 1/2016 Ade-Fosudo ..... E21B 33/1275
2002/0189805 A1 12/2002 Howard
2004/0194964 A1 * 10/2004 Tieben ..... E21B 43/127 166/369
2004/0251020 A1 * 12/2004 Smith ..... E21B 34/10 166/236
2007/0110598 A1 5/2007 Jacobs et al.
2008/0000639 A1 * 1/2008 Clark ..... E21B 43/14 166/281
2009/0183882 A1 * 7/2009 van Zuilekom .... E21B 33/1243 166/371
2010/0155050 A1 * 6/2010 Frazier ..... E21B 33/134 166/102
2011/0186298 A1 * 8/2011 Clark ..... E21B 43/14 166/310
2012/0305253 A1 * 12/2012 O'Malley ..... E21B 43/105 166/302
2012/0312559 A1 * 12/2012 Bailey ..... E21B 43/106 166/387
2016/0130920 A1 * 5/2016 Farebrother ..... E21B 43/121 166/372

FOREIGN PATENT DOCUMENTS

CN 101680277 A 3/2010
CN 201723423 U 1/2011
CN 102449261 A 5/2012
CN 202970640 U 6/2013
RU 62658 U1 4/2007
RU 2 383 729 C2 3/2010
WO WO 92/21880 A1 12/1992
WO WO 2008/153698 12/2008
WO WO 2010/135119 A1 11/2010
WO WO 2014190406 A1 * 12/2014 ..... E21B 43/121

OTHER PUBLICATIONS

International Search Report for PCT/EP2014/063364 dated Aug. 25, 2014, four pages.
Written Opinion of the Isa for PCT/EP2014/063364 dated Aug. 25, 2014, six pages.
Notification of the First Office Action dated Apr. 12, 2017 in Chinese Applicalon No. 201480033548.4, with English Translation (22 pages).
Decision on Patent Grant for Invention dated Apr. 4, 2018 in Russian Application No. 2016100242/03(000290), with English translation (25 pages).

* cited by examiner

DOWNHOLE PUMPING ASSEMBLY AND A DOWNHOLE SYSTEM

This application is the U.S. national phase of International Application No. PCT/EP2014/063364 filed 25 Jun. 2014 which designated the U.S. and claims priority to EP 13173705.8 filed 26 Jun. 2013, the entire contents of each of which are hereby incorporated by reference.

FIELD OF THE INVENTION

The present invention relates to a downhole pumping assembly for being introduced in a well inside a casing and submerged in well fluid. The present invention further relates to a downhole system comprising the downhole pumping assembly and to a method for pressurising an annular barrier using a downhole pumping assembly.

BACKGROUND ART

Downhole operations often include the pumping of fluids for various purposes. Known systems for performing pumping operations, such as coiled tubing gas lifting for removing water, require a lot of surface equipment, such as coil spools and gas tanks. Further, known pumps often require high amounts of power which cannot be supplied via standard wireline cables. Special cables requiring additional surface equipment are therefore required, which makes such operations more complicated and expensive. A need therefore exists for a well downhole pumping assembly which may be deployed using standard mono- or multi-conductor wireline, requiring a minimum of surface equipment, planning and logistics.

Another problem encountered downhole is that not all casing components are capable of withstanding a pressure required to be able to expand annular barriers. Thus, there is a need for an alternative solution. Furthermore, when having annular barriers, it would be beneficial if the annular barriers could be expanded one at a time.

SUMMARY OF THE INVENTION

It is an object of the present invention to wholly or partly overcome the above disadvantages and drawbacks of the prior art. More specifically, it is an object to provide a simple and reliable wireline pumping device which may be used for various pumping operations downhole, such as for pressurising an annular barrier downhole. The above objects, together with numerous other objects, advantages, and features, which will become evident from the below description, are accomplished by a solution in accordance with the present invention by a downhole pumping assembly for being introduced in a well inside a casing and submerged in well fluid, the downhole pumping assembly extending in a longitudinal direction and being adapted for connection with a wireline, and the downhole pumping assembly comprising a pump section comprising:

- a tubular pump housing providing a pump chamber,
- an inlet provided in the tubular pump housing, the inlet being in fluid communication with the pump chamber,
- a first valve which is a one-way valve arranged for opening and closing the inlet to allow fluid to flow into the chamber,
- a plunger slidably disposed in the pump chamber,
- a pump rod operably connected to the plunger and extending from the plunger through the tubular pump housing,

- an outlet provided in the tubular pump housing, the outlet being in fluid communication with the pump chamber, and
- a second valve which is a one-way valve arranged for controlling a flow of fluid out of the chamber through the outlet, wherein the downhole pumping assembly further comprises:

- a linear actuator arranged in association with the tubular pump housing adapted to drive the pump rod, whereby, when the downhole pumping assembly is at least partially submerged into the well fluid, well fluid is drawn into the tubular pump housing through the inlet and expelled through the outlet in the tubular pump housing, and wherein the pump section further comprises at least one sealing element for isolating a first part of the casing from a second part of the casing.

The pump section may comprise two sealing elements provided on each side of the outlet.

Moreover, the pump section may comprise two sealing elements arranged around the housing and adapted to isolate an isolated section opposite an opening in the casing.

Also, the pump section may further comprise a second sealing element, and the two sealing elements may be disposed around the pump housing, one on each side of the outlet, the sealing elements being configured to provide an isolated section in an annulus between the downhole pumping assembly and the casing.

Hereby a pumping action is provided, as the plunger is moved in one direction to suck fluid into the pump chamber through the inlet controlled by the first valve and subsequently in an opposite direction to expel the fluid present in the pump chamber through the outlet controlled by the second valve.

Further, the plunger may comprise a protrusion, such as a ring-shaped protrusion, protruding from a first plunger face, the protrusion being configured to prevent the plunger from blocking the inlet of the pump chamber.

In addition, the protrusion may have openings for allowing fluid to pass even if the protrusion contacts the end face of the chamber.

Also, the first valve may be arranged in the inlet and the second valve may be arranged in the outlet, the first valve and the second valve allowing fluid to flow into the pump chamber and to leave the pump chamber, respectively.

Moreover, the sealing elements may be chevron seals.

Furthermore, the sealing elements may be compressible elements so that upon compression, an outer diameter of the sealing elements increases.

Additionally, the sealing elements may be inflatable or expandable by injection of fluid.

Further, the sealing elements may be cup seals.

Said cup seals may have an annular part and a projecting annular flange and the flanges may face each other, so that a pressure in the isolated section forces the flanges radially outwards, causing the flanges to contact the casing.

Also, the sealing elements may be adapted to maintain a pressure in the isolated section which is higher than a pressure outside the isolated section.

Two sealing elements may be provided on each side of the outlet.

In addition, the two sealing elements may be a first sealing element and a second sealing element, and the first sealing element may be a different type of sealing element than the second sealing element.

Moreover, the first valve and/or the second valve may be arranged in the tubular pump housing.

Further, the first valve may be arranged in the inlet, and the second valve may be arranged in the outlet.

Further, the downhole pumping assembly may be powered by a wireline.

Alternatively, the downhole pumping assembly may be powered by a battery.

Moreover, the housing may comprise fluid channels for inflating or expanding the sealing elements.

The downhole pumping assembly may further comprise holding means for compressing at least one of the cup seals while the downhole pumping assembly is inserted into the well.

Also, the plunger may divide the chamber into a first compartment and a second compartment, the second compartment being in fluid communication with the annulus outside the isolated section.

Furthermore, a distance between the two sealing elements arranged one on each side of the outlet may be less than 5 meters, preferably less than 3 meters and more preferably less than 1 metre.

In an embodiment, the pump section may further comprise a strainer element or filtering element configured to filtrate well fluid before such well fluid enters the inlet.

Moreover, the inlet may be provided in an end face or a side wall of the pump chamber and the outlet may be provided in the end face or the side wall of the pump chamber.

Additionally, the inlet may be provided in an end face or a side wall of the pump chamber and the outlet may be provided in the side wall or the end face of the pump chamber.

The downhole pumping assembly as described above may further comprise a shoulder configured to cooperate with a recess provided in the casing for controlling the positioning of the pump assembly downhole.

Moreover, the linear actuator may comprise:

- a tubular stroker cylinder comprising one or more piston housings,
- one or more piston elements slidably disposed in the piston housing to divide the piston housing into a first chamber and a second chamber,
- a stroker shaft operably connected to the piston element and adapted to be connected with the pump rod to provide reciprocation of the plunger,
- a pump for alternately supplying hydraulic fluid under pressure to the first chamber and the second chamber of the tubular stroker cylinder to reciprocate the piston element in the tubular stroker cylinder, and
- an electrical motor for driving the pump.

In an embodiment, the linear actuator may comprise a plurality of piston elements slidably disposed in a plurality of piston housings and operably connected to a stroker shaft connected with the pump rod.

Also, the linear actuator may comprise an electric linear motor, and a stroker shaft driven by the electric linear motor for connection with the pump rod to provide reciprocation of the plunger.

The downhole pumping assembly as described above may further comprise an anchor section for anchoring the downhole pumping assembly in the well, the anchor section comprising a plurality of hydraulically activatable anchoring elements which are extendable from the tool body, for engagement with the casing.

The present invention furthermore relates to a downhole system comprising the downhole pumping assembly as described above, and the casing.

The casing may comprise an annular barrier which comprises a tubular part mounted as part of the casing and an expandable sleeve surrounding the tubular part with an opening through which fluid enters to expand the sleeve, and the pump section of the downhole pumping assembly may be arranged opposite the opening for expanding the sleeve by pressurising fluid in an isolated section.

Moreover, the casing may be connected with a screen arranged outside the casing having an opening, and the pump section of the downhole pumping assembly may be arranged opposite the inlet of the screen for removing elements on an outside of the screen by pressurising fluid in the isolated section.

The present invention also relates to a method for removing elements on an outside of a screen using a downhole pumping assembly as described above, comprising the steps of:

- inserting the downhole pumping assembly into the wellbore,
- positioning the pump section of the downhole pumping assembly so that the sealing elements are positioned on each side of an opening to the screen, thereby sealing off the isolated section of the casing, and
- operating the pump section to pump fluid into the isolated section of the casing, whereby fluid is forced in through the screen via the inlet and out into the wellbore.

Furthermore, the present invention relates to a method for expanding an annular barrier using a downhole pumping assembly as described above, comprising the steps of:

- inserting the downhole pumping assembly into the wellbore,
- positioning the pump section of the downhole pumping assembly so that the sealing elements are positioned on each side of an opening of the annular barrier, thereby sealing off the isolated section of the casing, and
- operating the pump section to pump fluid into the isolated section of the casing, whereby fluid is forced into the opening and expands an expandable sleeve of the annular barrier.

Finally, in this method according to the present invention, well fluid may be sucked into the pump chamber via the inlet and expelled into the isolated section of the casing via the outlet when the pump section is operated.

In another embodiment, the linear actuator may comprise:

- a tubular stroker cylinder providing one or more piston housings,
- one or more piston elements slidably disposed in the piston housing to divide the piston housing into a first chamber and a second chamber,
- a stroker shaft operably connected to the piston element for connection with the pump rod to provide reciprocation of the plunger,
- a pump for alternately supplying hydraulic fluid under pressure to the first chamber and the second chamber of the tubular stroker cylinder to reciprocate the piston element in the tubular stroker cylinder, and
- an electrical motor for driving the pump.

Furthermore, the linear actuator may comprise a plurality of piston elements slidably disposed in a plurality of piston housings and operably connected to the stroker shaft.

Moreover, the linear actuator may comprise an electric linear motor and a stroker shaft driven by the electric linear motor for connection with the pump rod to provide reciprocation of the plunger.

Also, the downhole pumping assembly may be adapted to pump at a flow rate of preferably approximately 5-15 liters per minute.

Further, the downhole pumping assembly may further comprise a plug device instead of one of the sealing elements positioned furthest away from the top of the well, for providing a seal in an annulus between the downhole pumping assembly and the casing. The plug device may comprise a base part connected with the tubular pump housing and may have a through-going bore and one or more sealing elements disposed around the base part, extendable from the base part for sealing off the annulus.

Hereby, a simple and reliable pumping device is provided which is capable of running using standard wireline and of initiating a well by pumping well fluids from one side of the plug device to the isolated section. Further, as the pumping device is deployable using standard wireline, the amount of equipment needed to deploy the device is substantially reduced compared to known techniques for initiating wells. The reduced need for equipment greatly reduces the complexity of the initiation operation, thereby reducing the time and cost of such operations.

Moreover, the plug device may further comprise an anchor mechanism for fixating the downhole pumping assembly in the well, the anchor mechanism being slidably disposed around the base part and comprising a plurality of setting slips extendable from the base part in a substantial radial direction for engagement with the tubing or casing.

Furthermore, the plug device may further comprise a compression sleeve slidably disposed around the base part for compressing the one or more sealing elements, and the sealing elements may be adapted to extend from the base part to seal off the annulus when the compression sleeve is displaced in the longitudinal direction towards the one or more sealing elements, thereby applying a compression force to the one or more sealing elements.

The compression sleeve may comprise a cone-shaped section facing towards the anchor mechanism, the cone-shaped section being adapted to force the setting slips in a radial direction, at least upon activation of the anchor mechanism, when the plurality of setting slips are displaced towards the compression sleeve, thereby engaging the cone-shaped section.

In addition, the compression sleeve may be adapted to be displaced by displacement of the anchor mechanism, resulting in a subsequent compression of the sealing elements by the compression sleeve.

Further, the downhole pumping assembly may comprise an equalisation valve for equalising a differential pressure across the sealing elements when the plug device is set in a well.

Moreover, the downhole pumping assembly may further comprise one or more sensors for measuring a differential pressure across the plug device when the sealing elements have been set in a well.

Additionally, the downhole pumping assembly may further comprise an anchor section for anchoring the downhole pumping assembly in the well, the anchor section comprising a plurality of hydraulically activatable anchoring elements extendable from the tool body, for engagement with the casing.

Also, the downhole pumping assembly may further comprise a driving unit for driving the downhole pumping assembly forward in the well, such as in deviated wells or horizontal parts of a well.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
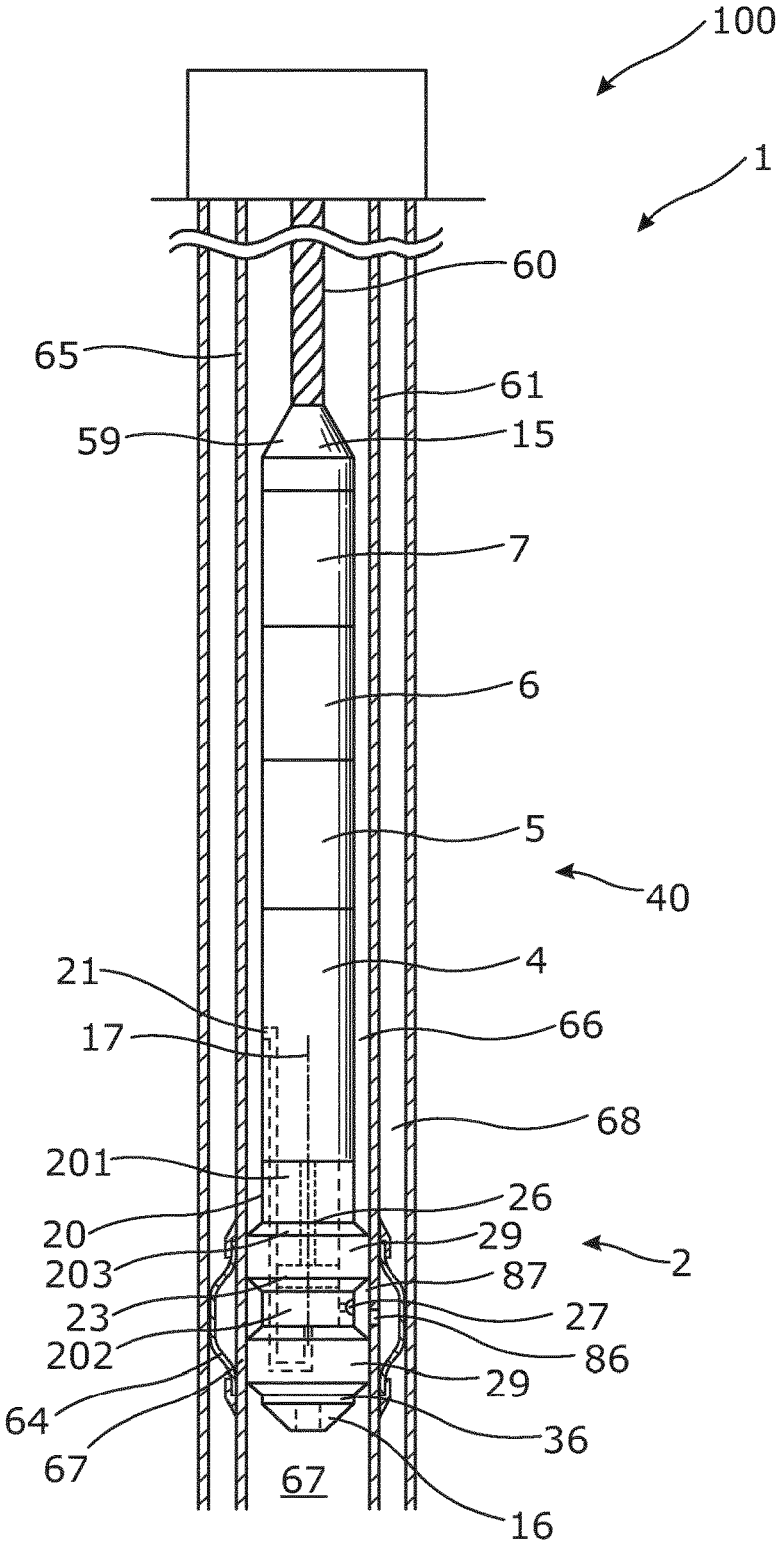
FIG. 1 shows a downhole pumping assembly arranged opposite an annular barrier to be expanded.

FIG. 1 shows a downhole pumping assembly 1 comprising a pump section 2, a linear actuator 40 and an electronic section 7. The downhole pumping assembly is a downhole assembly adapted to be suspended in a casing 61 in a well, forming a downhole system 100. The downhole pumping assembly further comprises two sealing elements 29 arranged one on each side of an outlet 27 of the assembly and opposite an opening 86 in the casing 61, creating an isolated section 87 for pressurising fluid to be ejected through the opening 86 and e.g. expand an annular barrier 64 as shown.

The downhole pumping assembly 1 uses a wireline 60 operably connected at a top end 15 of the downhole pumping assembly. The downhole pumping assembly 1 may also be powered by a battery and thus be wireless. In FIG. 1, the casing comprises an annular barrier 64 which comprises a tubular part 67 mounted as part of the casing and an expandable sleeve 65 surrounding the tubular part with an opening 86 through which fluid enters to expand the sleeve. The pump section 2 of the downhole pumping assembly is arranged opposite the opening 86 for expanding the sleeve 65 by pressurising fluid in the isolated section 87.

The pump section 2 is operably connected to the linear actuator 40, and the linear actuator provides the power input required to drive the pump section 2. The downhole pumping assembly is powered through the wireline 60, and the electronic section controls the powering and operation of the remainder of the downhole pumping assembly. The linear actuator 40 further comprises a pump 5 for driving a hydraulic cylinder 4 of the actuator driving the pump section, and an electrical motor 6 is provided for driving the pump. The pump section 2 comprises a tubular pump housing 20 which also constitutes a tool housing. The pump housing 20 defines a pump chamber 201. In the pump chamber 201, a plunger 23 arranged on a pump rod 26 is slidably disposed, thereby dividing the pump chamber into a first compartment 202 and a second compartment 203. The pump housing is provided with an inlet 21 in fluid communication with the first compartment 202 of the pump chamber 201, and the pump housing is further provided with an outlet 27, also in fluid communication with the first compartment 202 of the pump chamber.

In another embodiment, the linear actuator may comprise a gearing system instead of the pump and the hydraulic cylinder for transforming rotational energy of the motor into a linear motion of the plunger.

Figure 2:
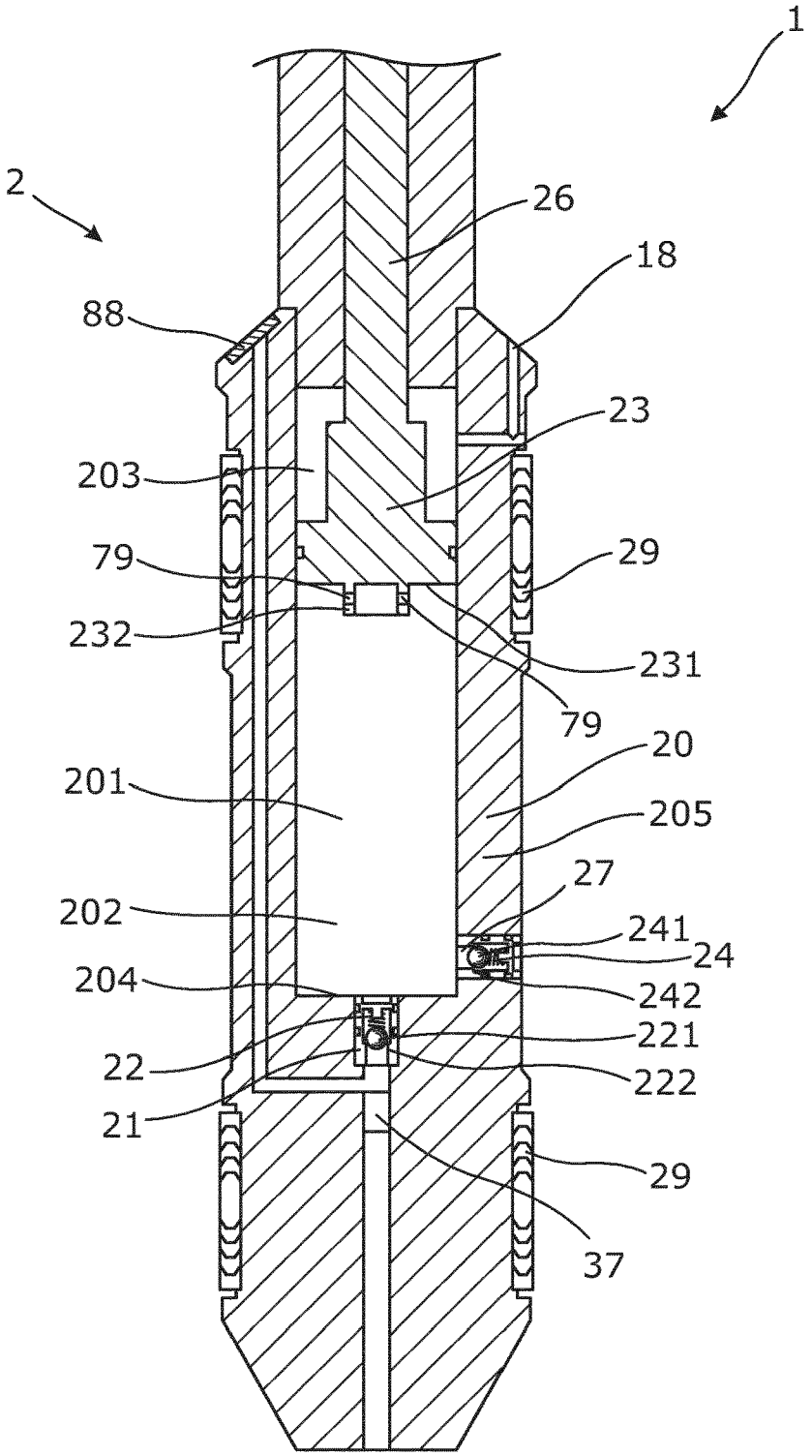
FIG. 2 shows a cross-section of a pump section of the downhole pumping assembly.

As shown in FIG. 2, a first valve 22 is arranged in the inlet 21 for controlling the flow of fluid through the inlet 21, and a second valve 24 is provided in the outlet 27 for controlling the flow of fluid through the outlet 27. Further, a protrusion 232, such as a ring-shaped protrusion, protrudes from a first plunger face 231 of the plunger facing the inlet and/or the outlet. The ring-shaped protrusion ensures a certain minimum distance between the plunger face and the end face of the pump chamber, and apertures 79 prevent the plunger from blocking the inlet provided in the wall of the pump housing. Still further, a strainer element 88 may be provided for filtrating well fluid before such well fluid enters the pump chamber or the inlet. Also, the pump section 2 comprises the pump rod 26 operably connected to the plunger 23 and extending from the plunger through the tubular pump housing for connection with a stroker shaft 45 of the linear actuator 40 shown in FIG. 4 or 5.

Figure 4:
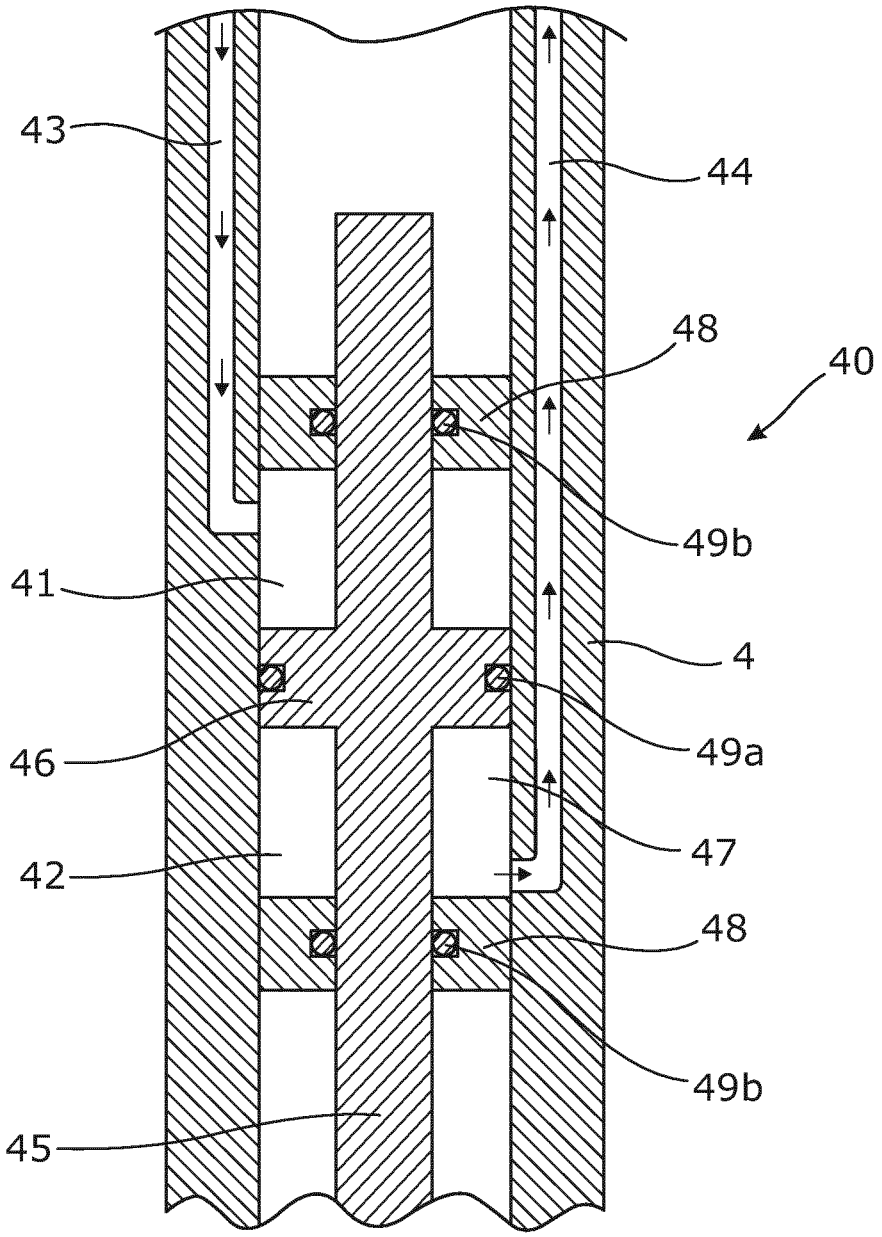
FIG. 4 shows a cross-section of one embodiment of a linear actuator.

The linear actuator 40 is arranged in association with the tubular pump housing 20, as shown in FIG. 1. As shown in FIG. 4, the linear actuator 40 comprises a tubular stroker cylinder 4 defining a piston housing 47 and a piston element 46 slidably disposed in the piston housing to divide the piston housing into a first chamber 41 and a second chamber 42. A stroker shaft 45 extending from the piston element is operably connected with the pump rod of the pump section, as described above, to provide reciprocation of the plunger in the pump chamber.

The linear actuator further comprises a pump 5 (shown in FIG. 1) for alternately supplying hydraulic fluid under pressure to the first chamber 41 and the second chamber 42 of the tubular stroker cylinder, and an electrical motor 6 is provided for driving the pump. When fluid is alternately supplied to the first chamber 41 and a second chamber 42, the piston element is reciprocated in the tubular stroker cylinder, thereby creating a linear motion. The linear motion is transferred via the stroker shaft 45 to the pump rod 26 (shown in FIGS. 2 and 3*a*), thereby reciprocating the plunger in the pump chamber, causing pumping effect to be created.

Referring to the embodiment of the pump section shown in FIG. 2, when the plunger 23 moves away from the inlet 21 and the first valve 22, well fluid is sucked in through the inlet 21, past the open first valve 22 and into the first compartment 202 of the pump chamber. The first valve is a one-way valve, such as a check-valve only allowing fluid to flow into the pump chamber. Thus, as the plunger 23 reaches an upper extreme position, the first compartment of the pump chamber has been flooded. A subsequent down-stroke motion of the plunger, wherein the plunger 23 moves towards the end face 204 of the pump chamber, forces the fluid out through the outlet 27 past the second valve 24. The second valve 24 is also a one-way valve, such as a check-valve, but it only allows fluid to flow out of the pump chamber and into the isolated section 87 (shown in FIG. 1 or 3*a*). The first valve 22 and the second valve 24 are embodied as check-valves of the ball-type and comprise a displaceable valve ball 221, 241 cooperating with a valve seat 222, 242 to control the flow direction. However, the skilled person would know that many other types of valves may be envisaged providing similar functionality.

Figure 3A:
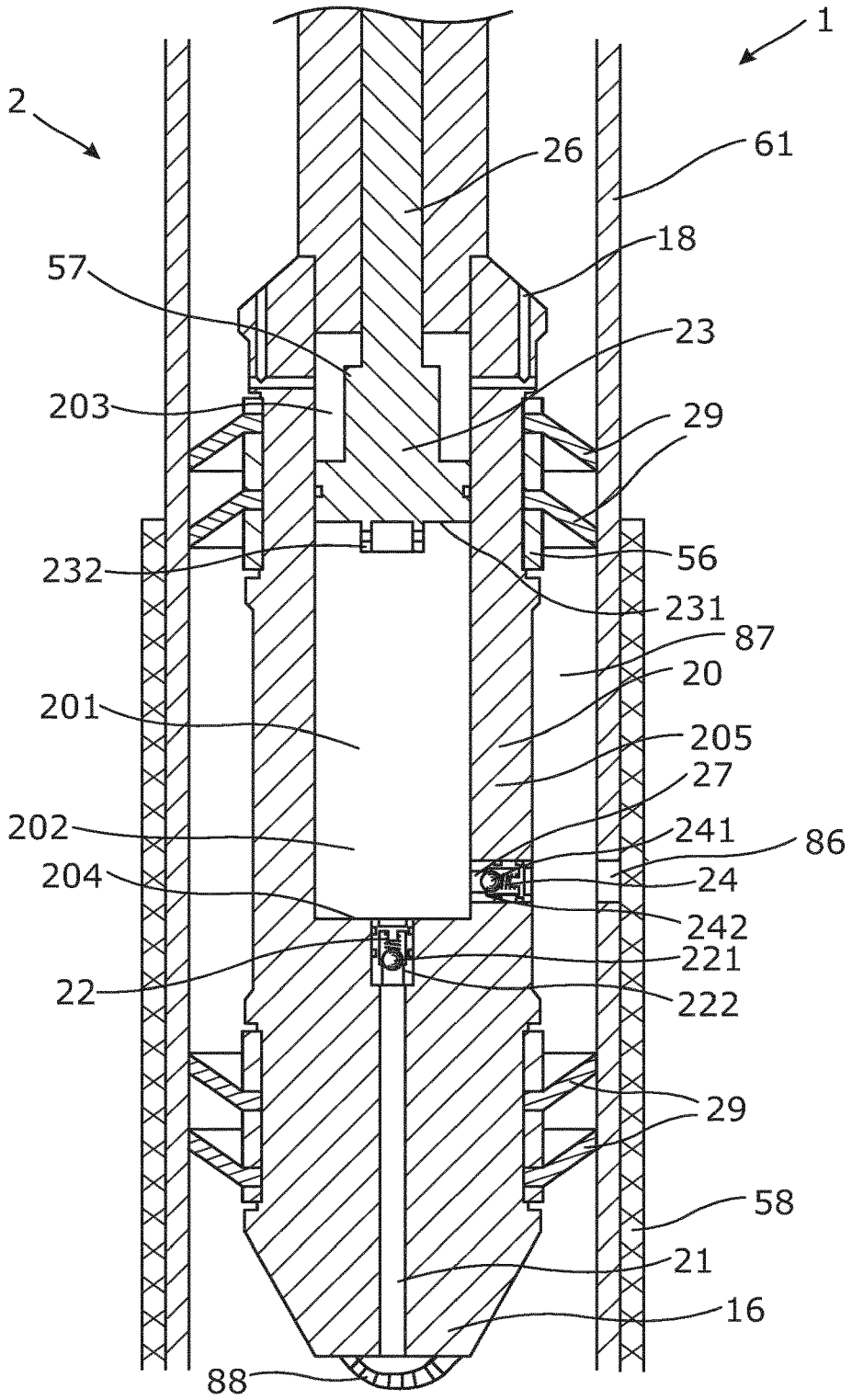
FIG. 3*a* shows a cross-section of another pump section of the downhole pumping assembly.

In FIG. 3*a*, the downhole pumping assembly 1 has four sealing elements 29 in the form of cup seals arranged, two on each side of the opening 86 in the casing 61, e.g. for removing elements on an outside of a screen 58 arranged on the outer face of the casing. In this way, should one seal fail, the other takes over. Furthermore, the inlet 21 is arranged in the second end of the downhole pumping assembly 1, so that fluid sucked into the first compartment 202 of the chamber is from the lower and second part of the casing or from the first and upper part of the casing as shown in FIG. 2. When the plunger 23 moves towards the inlet, fluid from the first part of the casing is sucked in through the aperture 18, and as the plunger returns, the fluid in the second compartment is expelled into the first part of the casing again. A filtering or strainer element 88 is provided in the second part 16 of the downhole pumping assembly to prevent dirt particles from entering the chamber of the downhole pumping assembly. The plunger has a circumferential projection 57 preventing the plunger from closing the apertures 18, and thus fluid can always enter the second compartment.

Figure 5:
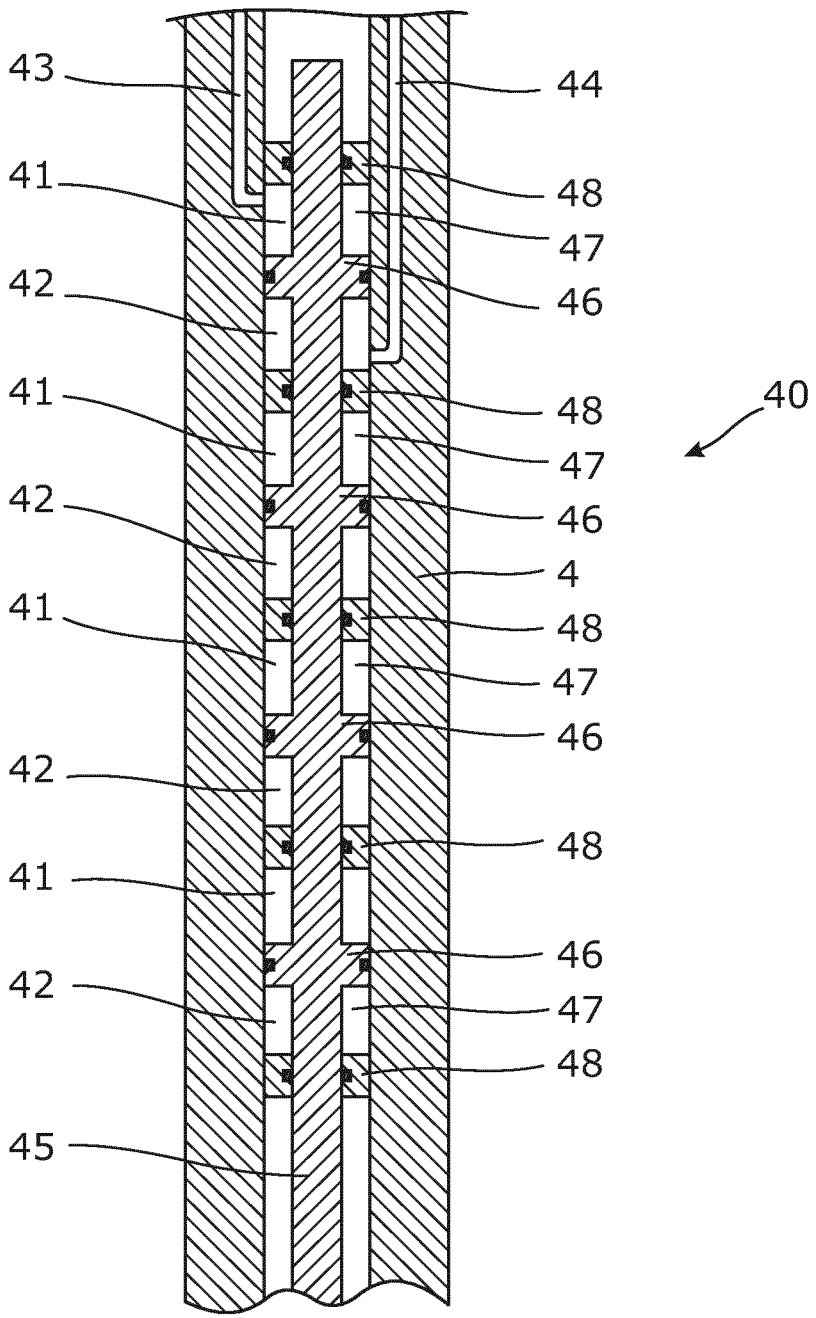
FIG. 5 shows a cross-section of another embodiment of a linear actuator.

Details about the design of the linear actuator are shown in FIGS. 4 and 5 showing different embodiments of a linear actuator. In both embodiments, the stroker shaft 45 extends through the tubular stroker cylinder 4 sectioned into one or more piston housings 47 by partitions 48. The partitions comprise a sealing means 49*b*, such as an O-ring, in order to provide a sealing connection between the partitions and the stroker shaft 45. In each of the piston housings 47, a piston element 46 is provided around the stroker shaft 45, so that the stroker shaft 45 may run back and forth within the tubular stroker cylinder 4 to provide the linear motion. Each of the piston elements 46 divides each of the one or more piston housings into a first chamber 41 and a second chamber 42, and the piston elements are provided with sealing means 49*a* in order to provide a sealing connection between the inside of the piston housing 47 and the outside of the piston element 46. As shown in FIG. 4, fluid is alternately supplied to the first chamber 41 and the second chamber 42 via the respective fluid channels 43, 44.

In the embodiment shown in FIG. 5, only the fluid channels in fluid communication with the first piston housing are shown. However, the other piston housings are provided with a similar arrangement of fluid channels. To provide the linear motion of the linear actuator, the pump of the linear actuator pumps fluid into the first chamber by sucking a corresponding amount of fluid from the second chamber 42, and vice versa. When the first chamber 41 is substantially filled, the pump shifts its pumping direction and pumps fluid from the first chamber 41 into the second chamber 42. Consequently, the piston element 46 is forced in the opposite direction. Consequently, the stroker shaft 45 is forced back and forth, thereby providing the linear motion. As can be seen in FIG. 4, the first chamber 41 is provided with a fluid channel 43 at one end of the piston housing 47, and the second chamber 42 is provided with a fluid channel 44 at the opposite end of the piston housing 47.

In this way, fluid can be sucked or pumped into each chamber until the piston element 46 almost abuts the partitions 48. The linear actuator is thus a closed system, meaning that the same fluid is recirculated by being pumped back and forth in the piston housing 47 in order to move the one or more piston elements 46 back and forth.

Figure 8:
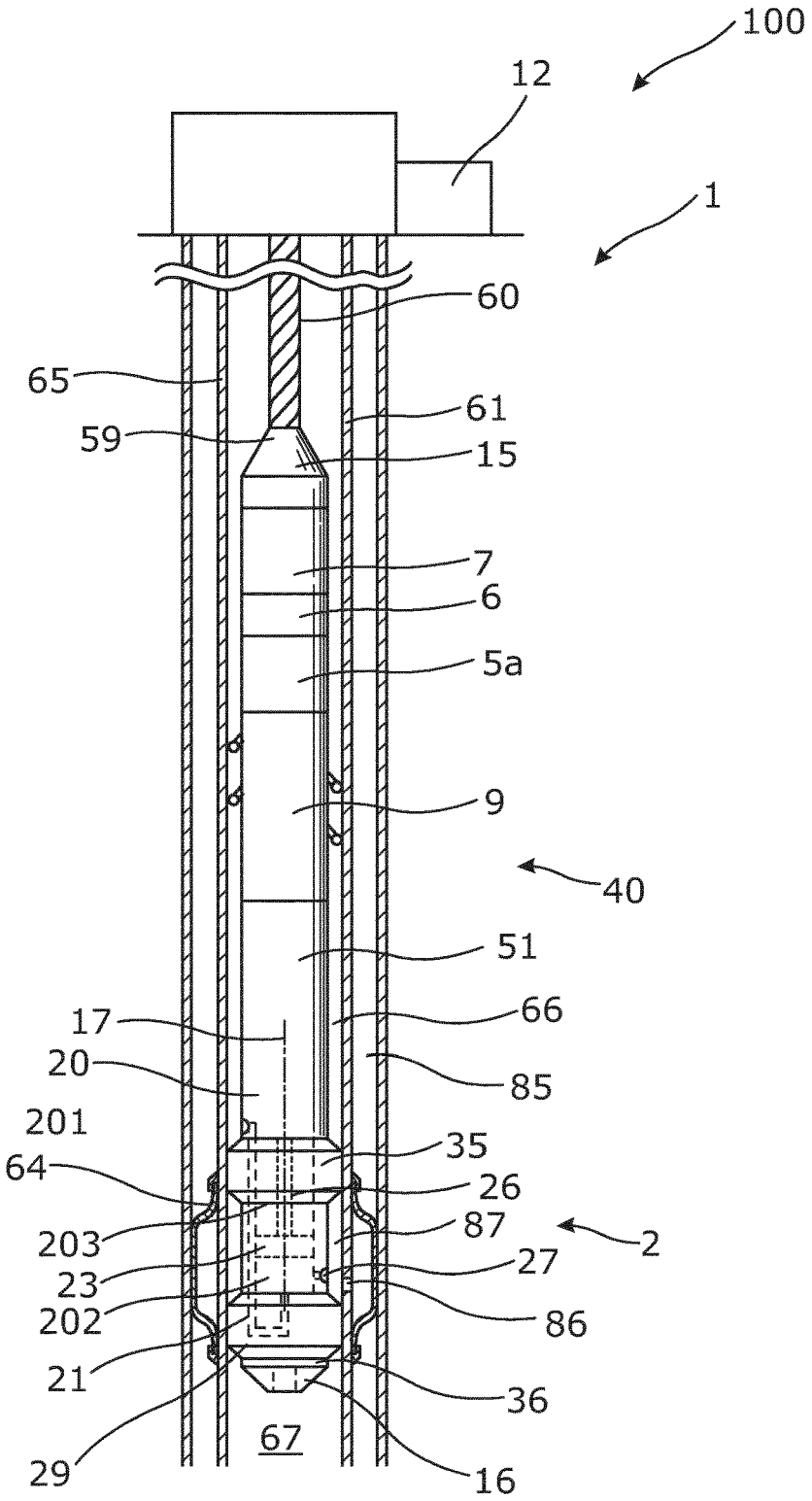
FIG. 8 shows the system comprising the downhole pumping assembly arranged opposite an opening of an annular barrier to be expanded.

In another embodiment, the linear actuator may comprise an electric linear motor 51 driving the stroker shaft, as shown in FIG. 8.

Figure 3B:
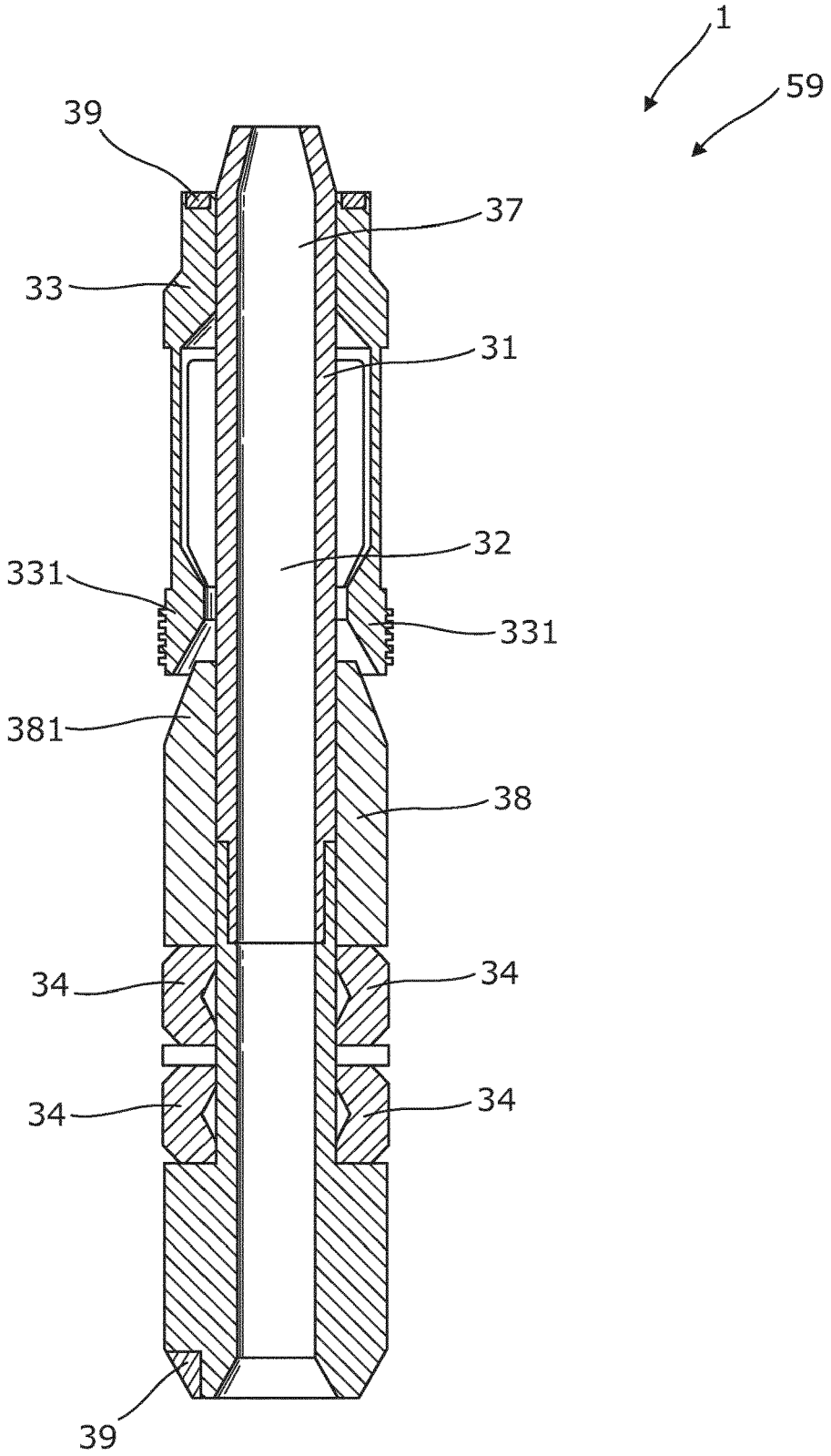
FIG. 3*b* shows a cross-section of a plug device.

FIG. 3*b* shows a downhole pumping assembly further comprising a plug device 59 arranged at the bottom end of the downhole pumping assembly, in continuation of the pump section. The plug device may be an integrated part of the downhole pumping assembly and be used instead of one of the sealing elements positioned furthest away from the top of the well. The plug device is adapted for anchoring the downhole pumping assembly in the well and for providing a circumferential seal in an annulus 62 between the downhole pumping assembly and the casing 61 (shown in FIG. 1). As shown in FIG. 3*b*, the plug device 59 comprises a base part 31 having a through-going bore 32 extending in a longitudinal direction and a plurality of sealing elements 34 disposed around the base part for sealing off the annulus. Above the sealing elements 34, a compression sleeve 38 and an anchor mechanism 33 are slidably disposed around the base part. The anchor mechanism comprises a plurality of setting slips 331 which are adapted to extend from the base part in a substantially radial direction. When the plug device is coupled to the pump section, the bore 32 of the plug device is in fluid communication with the inlet of the pump section shown in FIG. 3*b*. Well fluid may thus be sucked into the pump chamber 201 (shown in FIG. 2) of the pump section via the bore 32.

As shown in FIG. 3*b*, to set or activate the plug device, a force is applied to the anchor mechanism 33 in the longitudinal direction, thereby displacing the anchor mechanism towards the sealing elements. As the anchor mechanism is displaced, the setting slips 331 engage a cone-shaped section 381 of the compression sleeve 38 facing towards the anchor mechanism. The cone-shape of the compression sleeve forces the setting slips in an outwards radial direction for engagement with the casing when the downhole pumping assembly is positioned downhole. As the compression sleeve is also slidably disposed around the base part 31, displacement of the anchor mechanism 33 displaces the compression sleeve in the same direction towards the sealing elements. The sealing elements 34 are adapted to extend from the base part 31 to seal off the annulus when the compression sleeve is displaced. Displacement of the compression sleeve applies a compression force to the sealing elements 34, whereby the sealing elements are compressed in the longitudinal direction, resulting in the sealing elements buckling outwards. The cooperation relationship of the anchor mechanism, the compression sleeve 38 and the sealing elements 34 thus results in the setting slips 331 and the sealing elements 34 being simultaneously extended from the base part 31 to set the plug device.

In order to ease the removal of the downhole pumping assembly, the pressure across the sealing elements, i.e. the pressure in the first casing part above the sealing elements and the pressure in the second casing part below the sealing elements (shown in FIG. 1), may be equalised, which may be done by operating an equalisation valve 37 provided in a part of the downhole pumping assembly as shown in FIG. 2. When the pressure has been equalised, the downhole pumping assembly is pulled up into the lubricator and subsequently removed from the well. Subsequently, the downhole pumping assembly may easily be moved to the next well to perform a similar initiation operation.

Figure 6:
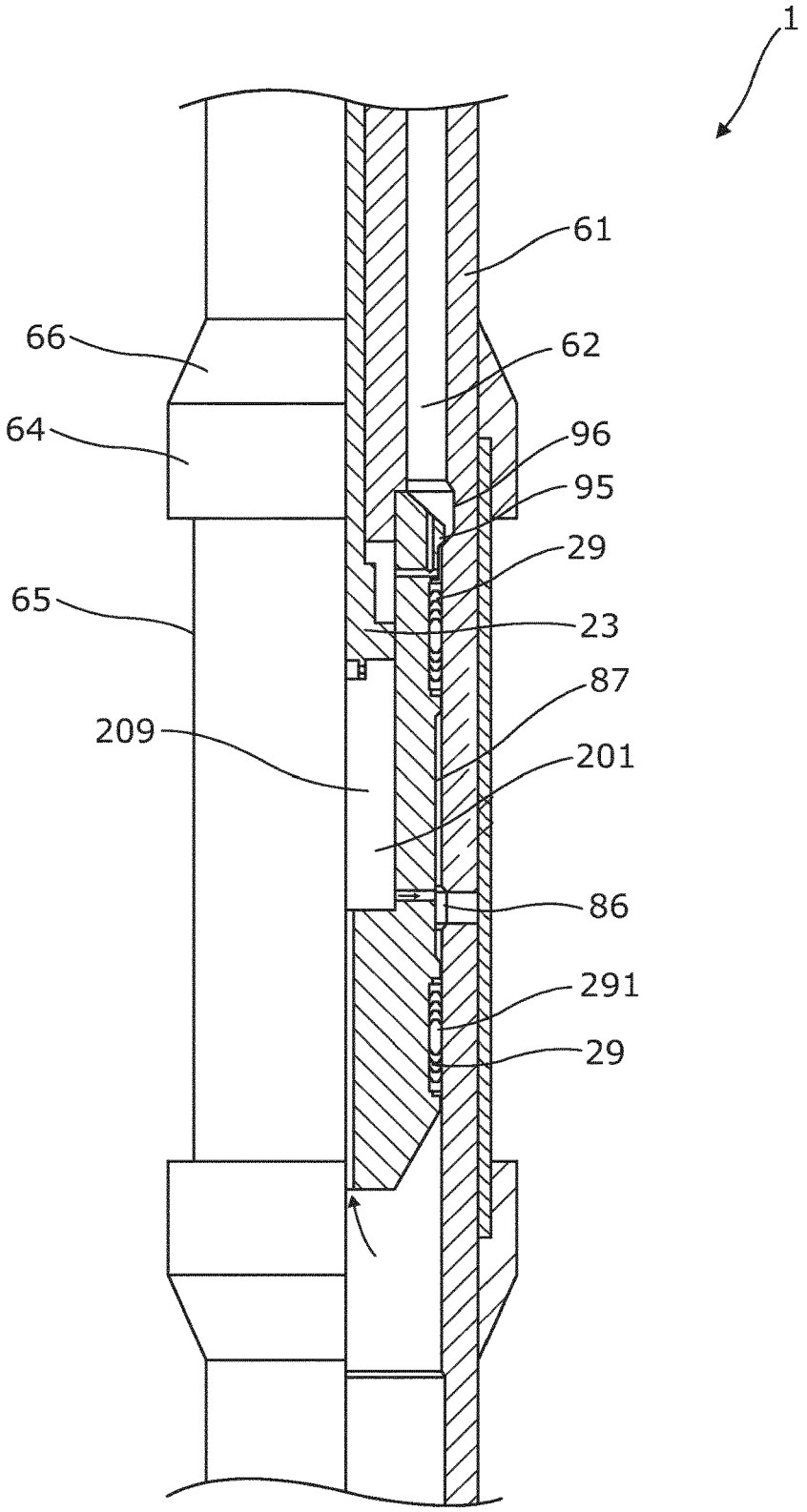
FIG. 6 shows a downhole pumping assembly comprising the pump section in a set condition inside a casing downhole opposite a screen.

FIG. 6 shows a downhole pumping assembly 1 configured for pressurising an expandable sleeve 65 of an annular barrier 64. As envisaged by the skilled person, the downhole pumping assembly shown, and the associated method described below, may also be used for expanding other types of barriers or plugs downhole. The shown downhole pumping assembly has been submerged inside a casing 61 and comprises the pump section shown in FIG. 8.

The shoulder 95 provided in the pumping device interacts with a recess 96 in the casing 61 to fixate the position of the downhole pumping assembly and ensure that the pump section is positioned in the correct position in relation to the opening in the annular barrier. The part of the casing comprising the recess 96 may be a landing nipple known to the skilled person. As shown in FIGS. 6 and 8, the two sealing elements 29 are positioned one on each side of an opening 86. Each sealing element is a chevron seal and hereby provides an isolated section 87 in the annulus between the downhole pumping assembly and the casing in order to seal off the section 87 of the casing opposite the annular barrier to be expanded.

To improve the collapse rating of the annular barrier, a hardening agent containing fluid 209 may be provided in the pump chamber 201 of the pump section prior to insertion of the downhole pumping assembly into the wellbore. Hereby, when the downhole pumping assembly is operated to pump a fluid into the isloated section 87, the fluid with the hardening agent is pumped into the isolated section and the annular barrier prior to fluid from the well.

Figure 7:
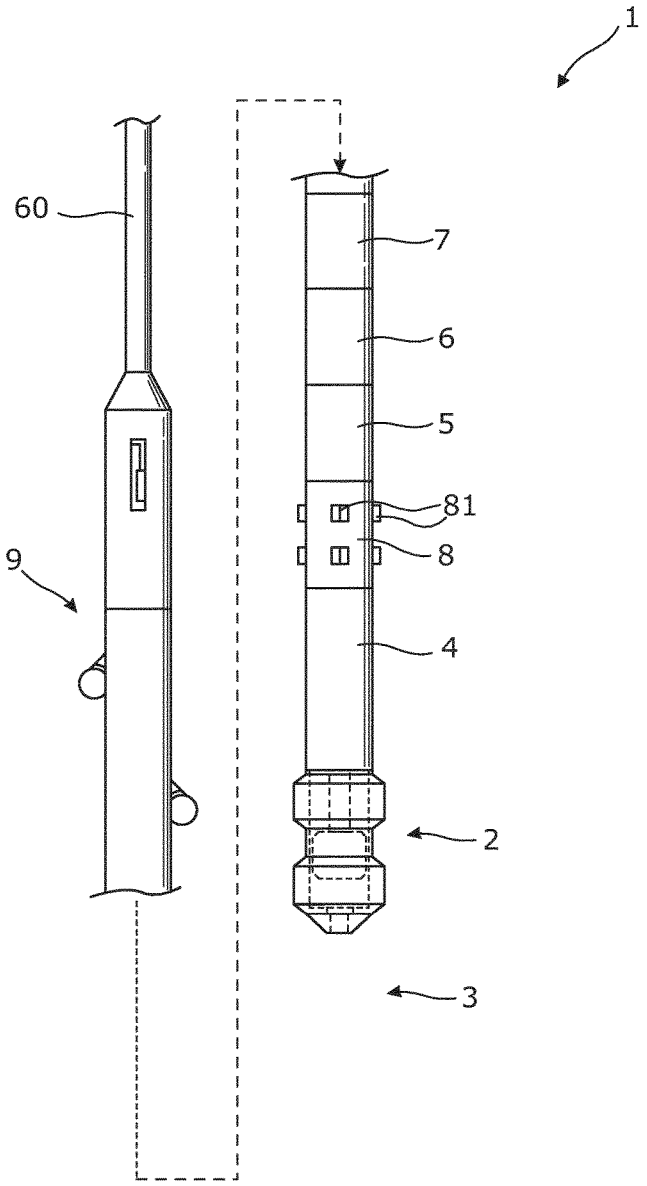
FIG. 7 shows a downhole pumping assembly comprising a driving unit and an anchor section.

In FIG. 7, the downhole pumping assembly 1 is provided with a driving unit 9 and an anchoring section 8. The driving section is adapted to drive the downhole pumping assembly forward in inclined sections of the well as shown in FIG. 8, and the anchoring section may be used for fixating the downhole pumping assembly downhole.

Figure 9:
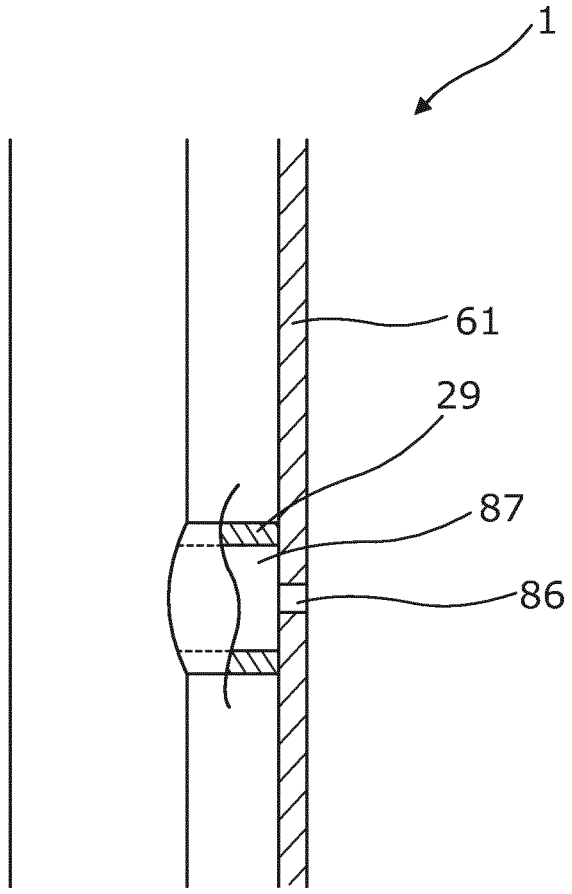
FIG. 9 shows a cross-sectional view of part of the downhole pumping assembly.

In FIG. 9, the downhole pumping assembly 1 comprises only one sealing element which is an annular seal for sealing around the opening, and the sealing element has the shape of a cup seal surrounding the opening 86 in the casing 61.

Figure 10A:
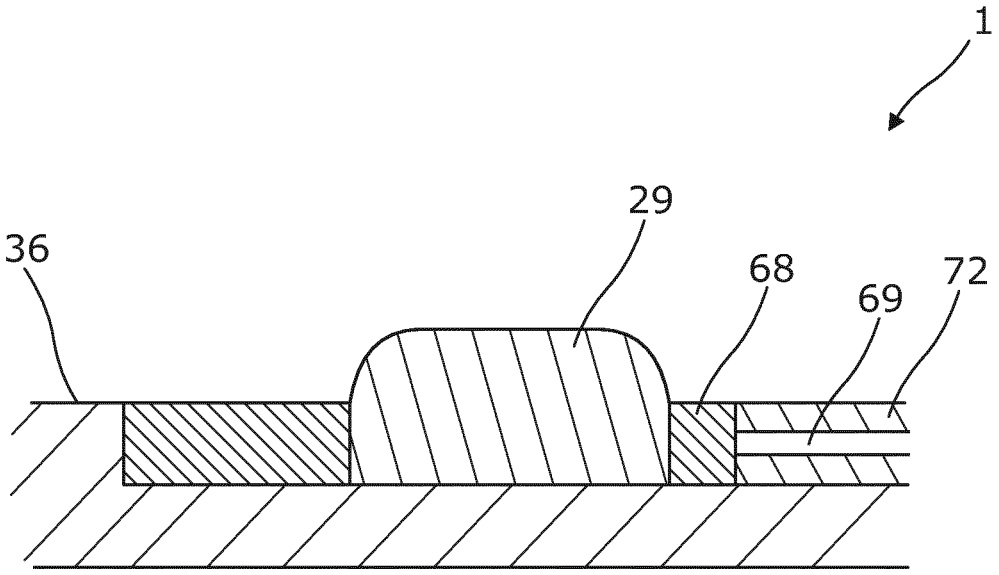
FIG. 10A shows a sealing element in an unexpanded condition.
Figure 10B:
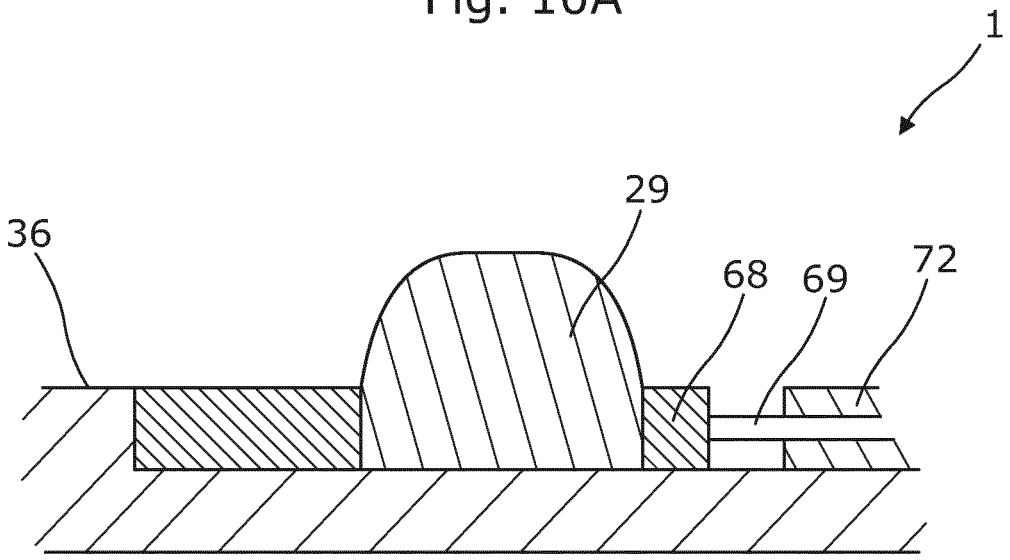
FIG. 10B shows the sealing element of FIG. 10A in an expanded condition.

The sealing elements are arranged around an outer face 36 of the housing of the downhole pumping assembly 1. In FIGS. 10A and 10B, the sealing element 29 is an elastomeric element which is compressed from one side by a piston 68 connected with a piston rod 69 of a hydraulic cylinder 72. In this way, the sealing element changes diameter to press against the inner surface of the casing.

Figure 11:
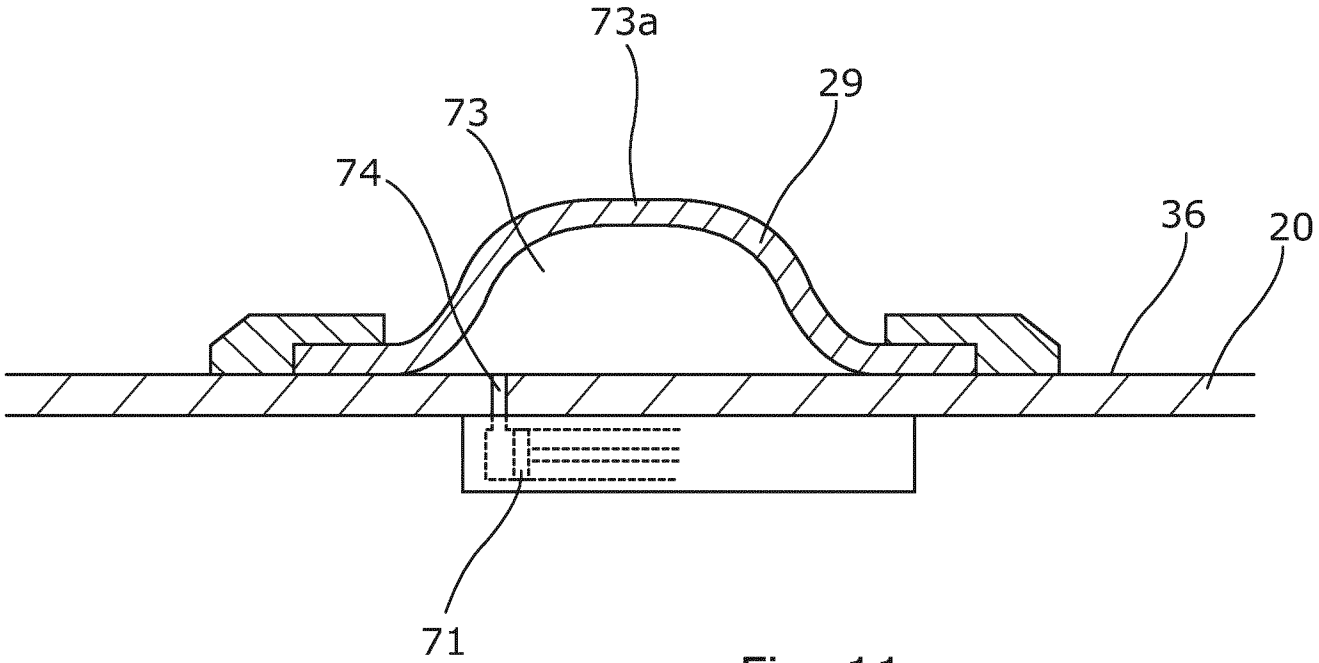
FIG. 11 shows the sealing element as being an inflatable element.

The sealing element 29 may also be an inflatable sleeve 73 as shown in FIG. 11, which element is inflated by fluid ejected into a space 73 defined by the sleeve 73*a* and the housing 20. The fluid is injected through an opening 74 in the housing by means of a hydraulic cylinder 71. When deflating the sleeve and thus the sealing element again, the piston in the hydraulic cylinder 71 is returned, the fluid in the space is sucked into the cylinder again and the sealing element 29 is deflated.

Figure 12:
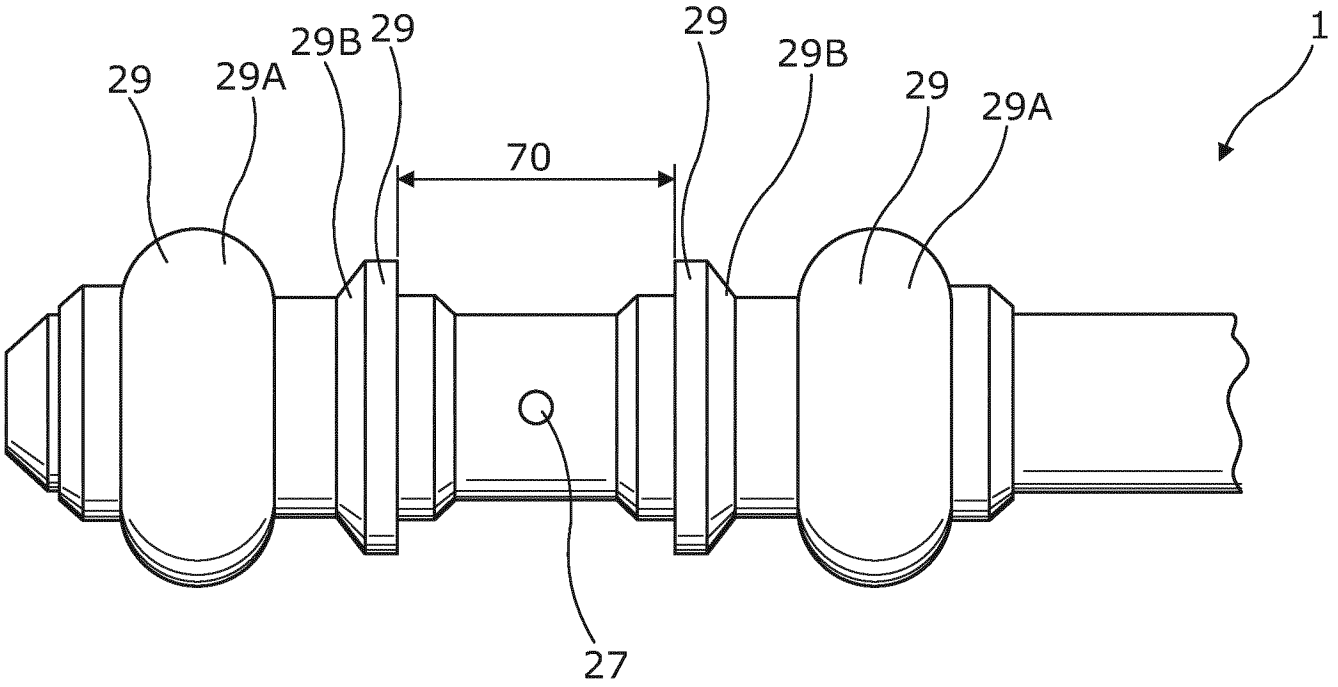
FIG. 12 shows the downhole pumping assembly having four sealing elements.

The downhole pumping assembly 1 may comprise four sealing elements 29, the sealing elements being arranged two on each side of the outlet 27 as shown in FIG. 12. The first sealing element 29A is an expandable or inflatable sealing element and the second sealing element 29B is a cup seal. The first elements are inflated or expanded to isolate the section opposite the outlet, and as the pressure increases, the cup seals expand to seal against the casing. In the event that the downhole pumping assembly 1 has to enter a casing having a diameter which is large in relation to its own outer diameter, this combination of sealing elements is beneficial. The distance 70 between the second sealing elements may vary from 0.1-5 meters.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the assembly is not submergible all the way into the casing, a downhole tractor can be used to push the assembly all the way into position in the well. The downhole tractor may have projectable arms having wheels, wherein the wheels contact the inner surface of the casing for propelling the tractor and the assembly forward in the casing. A downhole tractor is any kind of driving tool capable of pushing or pulling tools in a well downhole, such as a Well Tractor®.

Also, the linear actuator may be a Well Stroker®. Although the invention has been described in the above in connection with preferred embodiments of the invention, it will be evident for a person skilled in the art that several modifications are conceivable without departing from the invention as defined by the following claims.

The invention claimed is:

1. A downhole pumping assembly for being introduced in a well inside a casing and submerged in well fluid, the downhole pumping assembly extending in a longitudinal direction and being adapted for connection with a wireline, and the downhole pumping assembly comprising a pump section comprising:

a tubular pump housing providing a pump chamber, an inlet provided in the tubular pump housing, the inlet being in fluid communication with the pump chamber, a first valve which is a one-way valve arranged for opening and closing the inlet to allow well fluid to flow into the chamber, a plunger slidably disposed in the pump chamber and the first valve being separate from the plunger, a pump rod operably connected to the plunger and extending from the plunger through the tubular pump housing, an outlet provided in the tubular pump housing, the outlet being in fluid communication with the pump chamber, and a second valve arranged at the outlet and which is a one-way valve arranged for controlling a flow of well fluid out of the chamber through the outlet, wherein the downhole pumping assembly further comprises:

a linear actuator including a reciprocable stroker shaft, the linear actuator being arranged in association with the tubular pump housing, the stroker shaft being connected to the pump rod and adapted to reciprocatingly drive the pump rod, whereby, when the downhole pumping assembly is at least partially submerged into the well fluid, well fluid is drawn into the tubular pump housing through the inlet during movement of the stroker shaft in one direction and expelled through the outlet in the tubular pump housing during movement of the pump rod in a second direction opposite the first direction, and wherein the pump section further comprises at least one sealing element for isolating a first part of the casing from a second part of the casing, and wherein the at least one sealing element is provided on each side of the outlet.

2. A downhole pumping assembly according to claim 1, wherein the pump section comprises two sealing elements provided on each side of the outlet to create an isolated zone, and the inlet is positioned to receive well fluid from outside the isolated zone.

3. A downhole pumping assembly according to claim 2, wherein the sealing elements are chevron seals.

4. A downhole pumping assembly according to claim 2, wherein the sealing elements are compressible elements so that upon compression, an outer diameter of the sealing elements increases.

5. A downhole pumping assembly according to claim 2, wherein the sealing elements are inflatable or expandable by injection of fluid.

6. A downhole pumping assembly according to claim 2, wherein the sealing elements are cup seals.

7. A downhole pumping assembly according to claim 6, wherein the two sealing elements are a first sealing element and a second sealing element, and wherein the first sealing element is a different type of sealing element than the second sealing element.

8. A downhole pumping assembly according to claim 1, wherein the inlet is provided in an end face or a side wall of the pump chamber and the outlet is provided in the end face or the side wall of the pump chamber.

9. A downhole pumping assembly according to claim 1, wherein the linear actuator comprises a plurality of piston elements slidably disposed in a plurality of piston housings and operably connected to the stroker shaft connected with the pump rod.

10. A downhole pumping assembly according to claim 1, wherein the linear actuator comprises:

an electric linear motor, wherein the stroker shaft is driven by the electric linear motor for connection with the pump rod to provide reciprocation of the plunger.

11. A downhole system comprising the downhole pumping assembly according to claim 1, and the casing.

12. A downhole system according to claim 11, wherein the casing comprises an annular barrier which comprises a tubular part mounted as part of the casing and an expandable sleeve surrounding the tubular part with an opening through which fluid enters to expand the sleeve, and wherein the pump section of the downhole pumping assembly is arranged opposite the opening for expanding the sleeve by pressurising fluid in an isolated section.

13. A downhole system according to claim 11, wherein the casing is connected with a screen arranged outside the casing having an opening, and wherein the pump section of the downhole pumping assembly is arranged opposite the inlet of the screen for removing elements on an outside of the screen by pressurising fluid in the isolated section.

14. A method for removing elements on an outside of a screen using a downhole pumping assembly according to claim 1, comprising the steps of:

inserting the downhole pumping assembly into the wellbore, positioning the pump section of the downhole pumping assembly so that the sealing elements are positioned on each side of an opening to the screen, thereby sealing off the isolated section of the casing, and operating the pump section to pump fluid into the isolated section of the casing, whereby fluid is forced in through the screen via the inlet and out into the wellbore.

15. A method for expanding an annular barrier using a downhole pumping assembly according to claim 1, comprising:

inserting the downhole pumping assembly into the wellbore, positioning the pump section of the downhole pumping assembly so that the sealing elements are positioned on each side of an opening of the annular barrier, thereby sealing off the isolated section of the casing, and operating the pump section to pump fluid into the isolated section of the casing, whereby fluid is forced into the opening and expands an expandable sleeve of the annular barrier.

16. A downhole system according to claim 11, wherein the linear actuator includes a hydraulic pump operable by hydraulic fluid, the pump being configured to supply hydraulic fluid to a tubular stroker cylinder associated with the stroker shaft to reciprocate same.

17. A downhole system according to claim 11, wherein the pump housing includes a first compartment and a second compartment separated by the plunger, wherein the first compartment of the pump housing includes both the first and second one-way valves.

18. A downhole system according to claim 17, wherein the second compartment includes a passage, the inlet to the first compartment and the passage to the second compartment being positioned to receive well fluid from an exterior section of the pump housing, wherein the passage to the second compartment allows well fluid to enter into and flow out of the second compartment during reciprocable movement of the pump rod.

* * * * *